United States Patent [19]

Quack

[11] 4,048,814

[45] Sept. 20, 1977

[54] REFRIGERATING PLANT USING HELIUM AS A REFRIGERANT

[75] Inventor: Hans Quack, Pfaffikon, Switzerland

[73] Assignee: Sulzer Brothers Ltd., Winterthur, Switzerland

[21] Appl. No.: 675,064

[22] Filed: Apr. 8, 1976

[30] Foreign Application Priority Data

Apr. 15, 1975 Switzerland ..... 4777/75

[51] Int. Cl.[2] ..... F25B 7/00

[52] U.S. Cl. ..... 62/335; 62/514 R

[58] Field of Search ..... 62/62, 79, 335, 514 R

[56] References Cited

U.S. PATENT DOCUMENTS

| | | | |
|---|---|---|---|
| 3,199,304 | 8/1965 | Zeitz et al. | 62/79 |
| 3,360,955 | 1/1968 | Witter | 62/514 R |
| 3,375,675 | 4/1968 | Trepp et al. | 62/514 R |
| 3,611,740 | 10/1971 | Giger | 62/514 R |
| 3,878,691 | 4/1975 | Asztalos | 62/514 R |

*Primary Examiner*—Ronald C. Capossela

*Attorney, Agent, or Firm*—Kenyon & Kenyon, Reilly, Carr & Chapin

[57] ABSTRACT

The plant includes a precooling stage, a Joule/Thomson stage and a cryogenic load. The Joule/Thomson stage includes a pair of heat exchangers in which the helium emerging from the precooling stage is cooled by the return flow of helium. This stage also includes an expansion turbine between the heat exchangers to expand the high pressure helium to an intermediate pressure and an expansion element in which the helium is expanded to the liquefaction pressure. This expansion element is located upstream or downstream of the cryogenic load or between two parts of the cryogenic load.

7 Claims, 5 Drawing Figures

Fig. 4
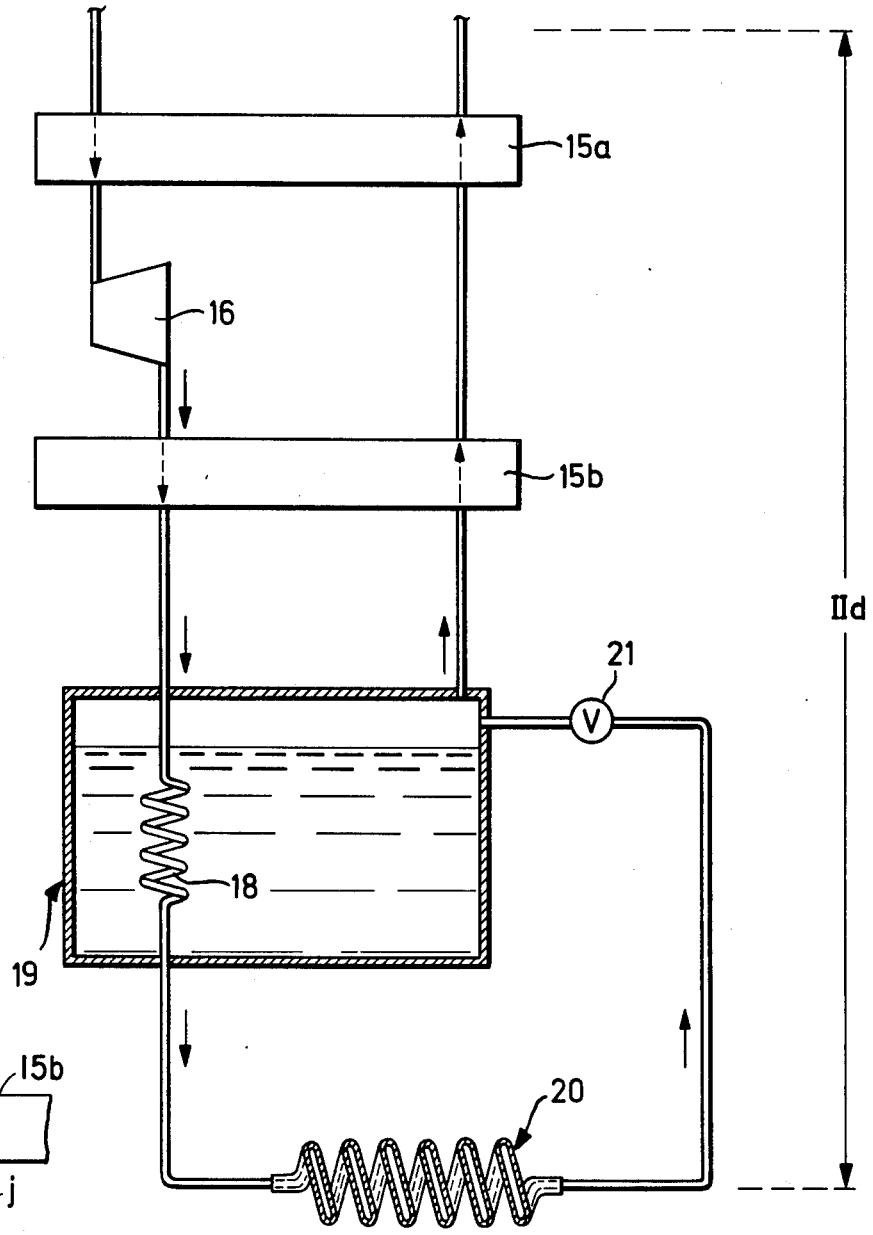
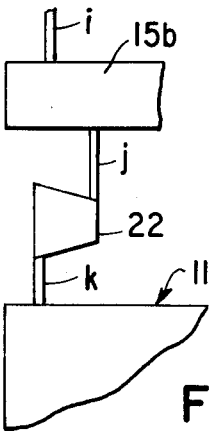
Fig. 5

REFRIGERATING PLANT USING HELIUM AS A REFRIGERANT

This invention relates to a refrigerating plant using helium as a refrigerant.

Refrigerating plants have been known which use helium as a refrigerant within a refrigerant circuit. For example, one such plant has been known which includes a precooling stage in which helium is compressed and is cooled by heat exchange and also, preferably, by expansion with the performance of work, a Joule/Thomson stage in which the helium cooled to a precool temperature below its inversion temperature is cooled to its liquefaction temperature by heat exchange and expansion with the performance of work, and a cryogenic load which supplies heat to the helium by heat exchange.

In the precooling stage of plants of this kind a compressor generally draws in helium gas at atmospheric pressure and ambient temperature and compresses the gas to a higher pressure. The gas is then cooled to a precool temperature below the inversion temperature by heat exchange in a number of countercurrent heat exchangers with low-pressure helium gas flowing back to the compressor from a helium reservoir and by expansion with the performance of work.

In simpler plants, the Joule/Thomson stage conventionally consists of a heat exchanger and a throttle valve in which the helium gas is expanded to liquefaction pressure. In such cases, the helium gas is cooled further in the heat exchanger by heat exchange with low-pressure helium gas, from the precool temperature to an enthalpy less than the enthalpy in the case of saturated vapor at one atmosphere pressure. In this way, partially liquid helium forms on throttling.

As is known, the refrigerating capacity of a refrigerating plant of the above type is determined by that quantity of heat which can be supplied by the cryogenic load to the liquid helium in order to vaporize the amount of liquid helium forming on throttling.

The energy balance of the Joule/Thomson stage with throttled expansion shows that the refrigerating capacity is determined by the product of the quantitative flow in the Joule/Thomson stage and the enthalpy difference of the two helium flows entering and leaving the heat exchanger at the hot end of the heat exchanger. To achieve a large enthalpy difference in order to obtain the maximum refrigerating capacity, the tendency is to keep the temperature difference at the hot end of the heat exchanger as small as possible, e.g. of the order of 0.2° K.

The plant refrigerating capacity, however, can be improved if the throttle valve in the Joule/Thomson stage is replaced by an expansion machine in which the high-pressure helium gas is expanded with the performance of work. The increase in the refrigerating capacity then corresponds to the energy dissipated by the expansion machine.

Low temperature refrigerating plants have already been proposed with a piston expansion machine in the Joule/Thomson stage. In such cases the helium emerges from the machine in the form of a gas-liquid two-phase flow. However, piston expansion machines are very susceptible to trouble because of inevitable mechanical friction. Consequently, one might therefore consider the use of expansion turbines instead.

It is well known that the efficiency of expansion turbines depends greatly on the size of the volume flow, the efficiency of an expansion turbine being in direct proportion to the volume flow. However, the specific volume of the high-pressure helium flow is very small on leaving the heat exchanger of the Joule/Thomson stage in the hitherto conventional constructions thereof. Thus, relatively large quantitative flows would therefore be necessary to obtain the maximum efficiency of the expansion turbine.

Accordingly, it is an object of the invention to provide a refrigerating plant with an improved Joule/Thomson stage.

It is another object of the invention to increase the refrigerating capacity of refrigerating plants using a Joule/Thomson stage.

It is another object of the invention to increase the efficiency of an expansion turbine in a Joule/Thomson stage of a refrigerating plant.

Briefly, the invention is directed to a refrigerating plant having a helium circuit in which helium circulates as a refrigerant and particularly to a plant comprising a precooling stage, a Joule/Thomson stage and a cryogenic load.

The precooling stage functions to cool a flow of helium to a temperature below the inversion temperature of the helium with the performance of work. To this end, the stage includes a means for compressing the flow of helium and means for cooling the compressed flow of helium.

The Joule/Thomson stage includes a pair of heat exchangers which are interposed in the helium circuit to place a flow of helium from the precooling stage in heat exchange with a flow of helium to the precooling stage to cool the flow of helium to the liquefaction temperature. In addition, the Joule/Thomson stage includes an expansion turbine between the heat exchangers for expanding the flow of helium to an intermediate pressure and an expansion means between an exit of the heat exchanger downstream of the expansion turbine, i.e. the low pressure turbine, and an entry to the heat exchanger for expanding the flow of helium to a liquefaction pressure.

The cryogenic load supplies heat to the flow of helium and is disposed between the exit and entry of the low pressure exchanger in the flow of helium.

The main advantage of the invention over the Joule/Thomson stage suggested above wherein use is made of a single heat exchanger followed by an expansion turbine in which the helium is expanded from high-pressure to liquefaction pressure is that the volume flow in the expansion turbine is increased because of the higher entry temperature of the high-pressure helium flow to the expansion turbine. This is due to the use of two heat exchangers and the following expansion to liquefaction pressure, the effect of which is to improve efficiency of the expansion turbine and hence achieve greater refrigerating capacity.

The provision of an expansion means after the second heat exchanger has the effect that the high-pressure helium flow can be expanded in the expansion turbine to an intermediate pressure higher than the liquefaction pressure of helium. The result of this intermediate pressure is that a positive temperature difference between the two helium flows in heat exchange with one another can be maintained in the second heat exchanger. Thus, heat can be transferred from the helium gas expanded with the performance of work to the helium vaporized in the cryogenic load.

Although a cryogenic load is frequently located at some distance from the remainder of the refrigerating plant. a pressure drop (pressure difference between the intermediate pressure and the liquefaction pressure) is available for the pipeline to the cryogenic load with the construction of the invention. Thus, the final expansion would take place at least partly in the pipeline itself and, in this special case, the pipeline itself can be regarded as the expansion means.

On the other hand, with some cryogenic loads, it is desirable that helium should flow through the cryogenic load at a supercritical pressure to give better heat transfer. This flow is conventionally supercooled in a reservoir with liquefied helium. In that case, expansion to the low pressure takes place in the expansion means so that liquid helium is not produced until the intermediate-pressure gas has passed through the load.

If the arrangement described hereinbefore, i.e. with a single heat exchanger in the Joule/Thomson stage and subsequent expansion of the high-pressure helium flow, were to be used, the result would be a reduced refrigerating capacity since in that case the high-pressure gas would also have to be expanded to an intermediate pressure in order to supply the pressure drop in the pipeline to the cryogenic load or allow cooling in the supercritical range of helium.

Apart from the case in which the pressure gradient available from the intermediate pressure to the liquefaction pressure is completely used up in the pipeline, the expansion means may be a throttle valve or may be another expansion turbine. This allows the refrigerating capacity to be increased still further.

These and other objects and advantages of the invention will become more apparent from the following detailed description and appended claims taken in conjunction with the accompanying drawings in which:

FIG. 4 illustrates a modified Joule/Thomson stage of another refrigerating plant embodying the invention; and FIG. 5 illustrates a modified arrangement having an expansion turbine as an expansion means.

Figure 1:
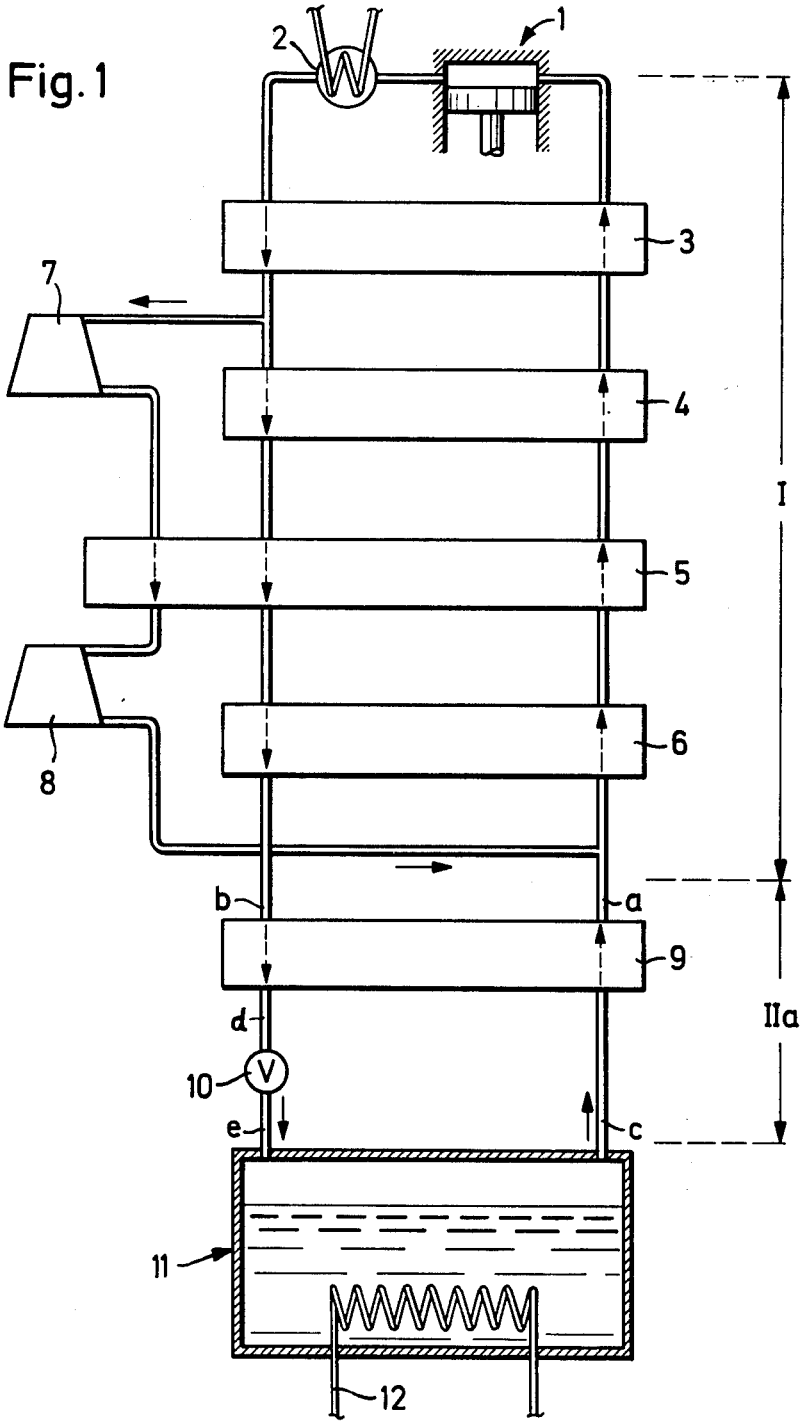
FIG. 1 illustrates a flow diagram of a previously proposed helium refrigerating plant with a precooling stage and a Joule/Thomson stage.

Referring to FIG. 1, a previously proposed refrigerating plant using helium as a refrigerant within a closed circuit comprises a precooling stage I consisting of a compressor 1 with a cooler 2 for dissipating compression heat, heat-exchangers 3 to 6 and expansion turbines 7 and 8. When in use, a compressed helium gas is cooled to a precool temperature below the inversion temperature in the precooling stage by heat-exchange or by expanding a helium branch flow with the performance of work. Proposals have also been made to obtain cooling by means of external refrigerants, e.g. nitrogen and hydrogen, via heat exchange, instead of cooling by means of expansion turbines.

The plant also comprises a Joule/Thomson stage II*a* consisting in this case of a single-unit heat exchanger 9 and a throttle valve 10 in which the helium gas is expanded from high pressure to liquefaction pressure of about 1 atmosphere, and is at the same time partially liquified.

The liquified helium is collected in a reservoir 11 connected to the Joule/Thomson stage and a cryogenic load 12, for example the coil of a superconductive magnet which, is diagrammatically illustrated as being located in the reservoir.

Figure 2:
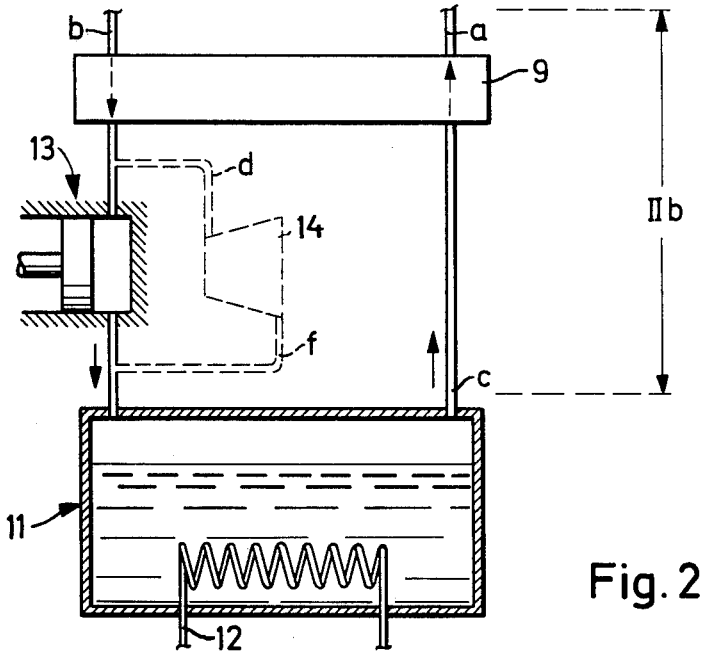
FIG. 2 illustrates a Joule/Thomson stage of another previously proposed refrigerating plant with a possible modification.

Referring to FIG. 2, wherein like reference characters indicate like parts as above described, another previously proposed refrigerating plant uses a precooling stage of similar construction to that of FIG. 1 and a Joule/Thomson stage II*b* which has a helium reservoir with a cryogenic load located therein. However, unlike the plant shown in FIG. 1, a piston expansion machine 13 is disposed after the heat exchanger 9 instead of a throttle valve. Also, in this machine 13, the helium gas is expanded from high pressure to liquefaction pressure with the performance of work and is partially liquefied in these conditions.

The broken lines in FIG. 2 show the possible replacement of the piston expansion machine 13 by an expansion turbine 14. It is believed that this construction of the Joule/Thomson stage has not previously been proposed but is being mentioned to provide a better explanation of the advantages of the invention and will be discussed in a numerical example hereinafter.

Figure 3:
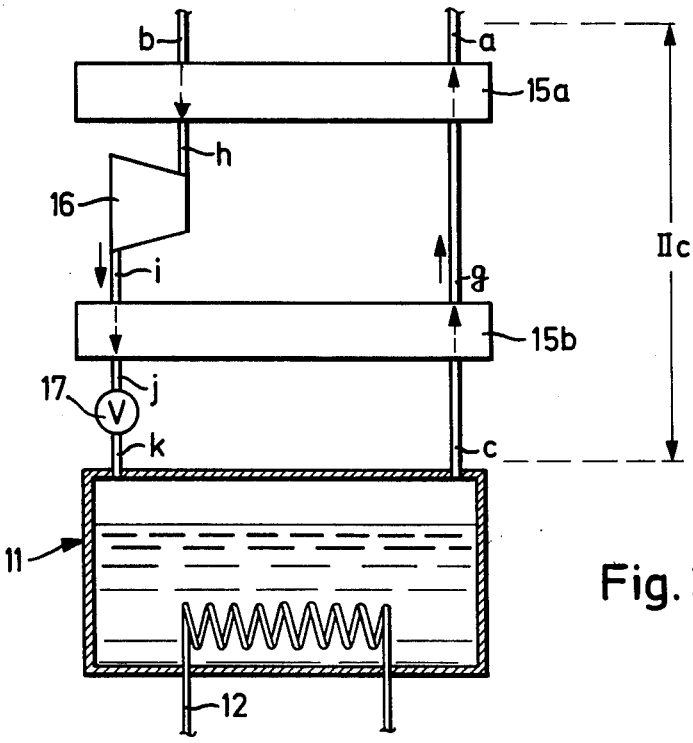
FIG. 3 illustrates a Joule/Thomson stage of a refrigerating plant embodying the invention.

Referring to FIG. 3, wherein like reference characters indicate like parts as above, the refrigerating plant according to the invention uses a precooling stage of similar construction to that shown in FIG. 1. However, by contrast with FIGS. 1 and 2, the Joule/Thomson stage has two separate heat exchangers 15*a* and 15*b* in order to effect a heat exchange in the countercurrent flows of the helium. In addition, an expansion turbine 16 is disposed in the high-pressure helium flow between the two heat exchangers and an expansion means in the form of a throttle valve 17 is provided between the second heat exchanger 15*b* and the helium reservoir 11.

As shown, the expansion turbine 16 is located via pipelines *h, i*, in the flow of helium passing from the precooling stage via a pipe while the throttle valve 17 is located in a pipeline *j* downstream of the turbine 16 between the exit of the low pressure heat exchanger 15*b* and the reservoir 11.

Referring to FIG. 4, wherein like reference characters indicate like parts as above, a modified refrigerating plant of the invention may have a cryogenic load which is cooled in the supercritical range. The helium flow which is expanded in the Joule/Thomson stage II*d* to an intermediate pressure with the performance of work and which is further cooled in the heat exchanger 15*b* is further cooled by heat exchange with liquefied helium upon passing through a coil 18 in the reservoir. The helium then flows through the cryogenic load 20, e.g. a magnet coil constructed as a tubular conductor, and is then expanded to liquefaction pressure in the throttle valve 21 and fed into the helium reservoir 19.

As already explained hereinbefore and as will be apparent from the following numerical example, a refrigerating plant provided with a Joule/Thomson stage according to the invention can give a higher refrigerating capacity than the constructions shown in FIG. 1 and in FIG. 2 with the expansion turbine 14 under otherwise identical conditions, such as identical precooling temperature and identical mass flow. This effect is achieved by using at least one expansion turbine which is extremely reliable in operation unlike a piston expansion machine.

The important variables for the numerical example given in the following Table are the pressures in atmospheres, temperatures in ° K and enthalpies (J/g) at the places marked *a* to *k* in FIGS. 1 to 3.

| Place | Pressure p (atm) | Temperature T (° K) | Enthalpy h (J/g) |
|---|---|---|---|
| a | 1 | 13.8 | 85.26 |
| b | 16 | 14.0 | 73.06 |
| c | 1 | 4.224 | 30.13 |
| d | 16 | 4.655 | 17.93 |
| e | 1 | 4.224 | 17.93 |
| f | 1 | 4.224 | 11.23 |
| g | 1 | 5.29 | 38.06 |
| h | 16 | 6.826 | 25.86 |
| i | 3 | 5.44 | 18.85 |
| j | 10 | 4.374 | 10.92 |
| k | 1 | 4.224 | 10.92 |

The following values of the specific refrigerating capacity are obtained with the individual embodiments.

Refrigerating plants according to

FIG. 1: $h_c - h_e = 12.2$ J/g
FIG. 2: $h_c - h_f = 18.9$ J/g
FIG. 3: $h_c - h_k = 19.21$ J/g

K All three embodiments are based on the same precool temperature $T_b = 14.0°$K and the same exit temperature of the low-pressure helium flow $T_a = 13.8°$ K and the same mass flow.

Comparison of the important variables of the expansion turbines in Figs. 2 and 3.

| | Fig. 2 | Fig. 3 |
|---|---|---|
| Inlet pressure | 16 atm | 16 atm |
| End pressure | 1 atm | 3 atm |
| Inlet temperature | 4.655° K | 6.826 |
| Exit temperature | 4.224° K | 5.440 |
| Isentropic drop | 10.31 J/g | 10.4 J/g |
| Specific volume at inlet | 6.386 cm 3/g | 7.328 cm 3/g |
| Efficiency | 0.65 | 0.674 |
| Dissipated energy | 6.70 J/g | 7.01 J/g |

In the second case, the expansion turbine dissipates more energy for two reasons: First, because the isentropic drop is already greater (10.4 as against 10.31) and, second, because the turbine has a better efficiency (0.674 as against 0.65) because of the greater specific volume of the gas.

It should be noted that the extent to which the efficiency of the expansion turbine improves with increasing volume flow depends on the type of construction and overall size of the expansion turbine.

The difference in efficiency from 0.674 to 0.650 in the numerical example is typical of relatively small expansion turbines for a throughput volume of the order of 500–1000 cubic centimeters per second ($cm^3/s$) for a specific inlet volume difference of 15%.

Various modifications may be made to the plants shown in FIGS. 3 and 4. For example, the throttle valves 17 and 21 may be replaced by expansion turbines 22 (FIG. 5). In the construction shown in FIG. 4, the cryogenic load 20 may be divided into two parts with the throttle valve 21 between them.

What is claimed is:

1. A refrigerating plant having a helium circuit in which helium circulates as a refrigerant, said plant comprising a precooling stage to precool a flow of helium to a temperature below the inversion temperature thereof with the performance of work, said stage including means for compressing the flow of helium and means for cooling the compressed flow of helium;

a Joule/Thomson stage including a pair of heat exchangers interposed in said helium circuit to place a flow of helium from said precooling stage in heat exchange relation with a flow of helium to said precooling stage to cool the flow of helium from said precooling stage to the liquefaction temperature thereof, an expansion turbine between said pair of heat exchangers in the flow of helium from said precooling stage for expanding the flow of helium to an intermediate pressure, and an expansion means in the flow of helium between the exit of the heat exchanger of said pair of heat exchangers downstream of said expansion turbine in the flow of helium from said precooling state and the entry to said heat exchanger in the flow of helium to said precooling stage for expanding the flow of helium to a liquefaction pressure; and a cryogenic load for supplying heat to the flow of helium, said load being disposed between said exit and said entry of said heat exchanger in the flow of helium.

2. A refrigerating plant as set forth in claim 1 wherein said means for cooling in said precooling stage is a means for expanding the flow of helium with the performance of work.

3. A refrigerating plant as set forth in claim 1 wherein said expansion means is upstream of said cryogenic load relative to the flow of helium.

4. A refrigerating plant as set forth in claim 1 wherein said expansion means is downstream of said cryogenic load relative to the flow of helium.

5. A refrigerating plant as set forth in claim 1 wherein said cryogenic load includes two parts for individually supplying heat to the flow of helium and said expansion means is disposed between said two parts relative to the flow of helium.

6. A refrigerating plant as set forth in claim 1 wherein said expansion means is a throttle valve.

7. A refrigerating plant as set forth in claim 1 wherein said expansion means is an expansion turbine.

* * * * *